United States Patent [19]

Kato et al.

[11] 4,403,921

[45] Sep. 13, 1983

[54] MULTI-CYLINDER VARIABLE DELIVERY COMPRESSOR

[75] Inventors: Kimio Kato; Hiroya Kono; Hisao Kobayashi, all of Kariya, Japan

[73] Assignee: Kabushiki Kaisha Toyoda Jidoshokki Seisakusho, Japan

[21] Appl. No.: 313,681

[22] Filed: Oct. 21, 1981

[30] Foreign Application Priority Data

Oct. 27, 1980 [JP] Japan ..... 55-151298
Dec. 10, 1980 [JP] Japan ..... 55-175027
Dec. 13, 1980 [JP] Japan ..... 55-176256

[51] Int. Cl.[3] ..... F04B 49/08; F04B 1/16; F04B 1/18

[52] U.S. Cl. ..... 417/296; 417/297

[58] Field of Search ..... 417/296, 297, 269, 270

[56] References Cited

U.S. PATENT DOCUMENTS 1,653,110 12/1927 Le Valley ..... 417/296
2,726,032 12/1955 Cooper et al. ..... 417/296
3,545,220 12/1970 Teegarden ..... 417/299
3,611,715 10/1971 Tatsutomi et al. ..... 417/293
4,105,370 8/1978 Brucker ..... 417/269
4,373,870 2/1983 Dandzik ..... 417/269

FOREIGN PATENT DOCUMENTS 2615627 10/1976 Fed. Rep. of Germany ..... 417/297
55-160187 12/1980 Japan ..... 417/270

*Primary Examiner*—William L. Freeh
*Attorney, Agent, or Firm*—Burgess, Ryan & Wayne

[57] ABSTRACT

A multi-cylinder variable delivery compressor containing a plurality of compression chambers is adapted for use in compressing a refrigerant gas of a cooling circuit. The compressor has a first delivery chamber communicating with the compression chambers by way of a fixedly arranged delivery valve means and a second delivery chamber communicating with the compression chambers by way of a movably arranged delivery valve means.

The movable delivery valve means is urged from its closing position toward its opening position, and is moved back to its closing position when a delivery pressure from the cooling circuit is applied to the movable delivery valve means.

8 Claims, 21 Drawing Figures

MULTI-CYLINDER VARIABLE DELIVERY COMPRESSOR

FIELD OF THE INVENTION

The present invention relates to a multi-cylinder variable delivery compressor adapted for use in a vehicle air-conditioning system.

BACKGROUND OF THE INVENTION

Generally, the cooling of a vehicle compartment (i.e. passenger compartment of a vehicle) is carried out in one of the following two ways. That is, one is decreasing the temperature of the vehicle compartment, while the other is keeping a comfortable low temperature in the vehicle compartment. While decreasing the temperature, the compressor of an air-conditioning system of a vehicle has to exert a high cooling performance, and while maintaining a comfortable low temperature, the compressor has to exert a rather low cooling performance. In the conventional air-conditioning system of a vehicle, a compressor having as large as possible cooling capacity permitted by the vehicle's engine performance is often employed for satisfying the requirement for a rapid cooling of the vehicle compartment. Therefore, while the vehicle is driven under a normal running state and while the vehicle compartment is cooled so as to be kept at a comfortable low temperature, the cooling capacity of the compressor is excessively large with respect to the cooling load. As a result, the compressor per se must be driven under a rather low cooling load. Accordingly, during the operation of the compressor, the volumetric efficiency of the compressor must be low. Further, a clutch that is arranged between the vehicle engine and the compressor must often be connected and disconnected. This operation causes the clutch to wear out rapidly. Moreover, everytime the clutch is disconnected and connected, a large starting torque is necessary for starting the compressor. That is, a large change in the driving torque of the compressor occurs. This fact adversely affects comfortable driving of the vehicle. Further, when a compressor is started, there sometimes occurs a liquid compression which deteriorates the durability of the compressor, if the volume of the exhaust chamber of the compressor is rather small. In addition, such liquid compression causes the generation of loud noise. In some de-luxe cars, the conventional compressor of the air-conditioning system is continuously driven, and the amount of the refrigerant gas coming into the compressor is controlled by a pressure control valve arranged adjacent to the outlet of an evaporator of the air conditioning system. If the car compartment is excessively cooled, the air is heated up to an appropriate temperature and is blown into the compartment. This method is therefore extremely uneconomical.

SUMMARY OF THE INVENTION

An object of the present invention is therefore to provide a variable delivery compressor whereby the above-mentioned defects in the conventional vehicle air-conditioning compressor are obviated.

Another object of the present invention is to provide a variable delivery compressor, the cooling capacity of which is varied in steps in response to a change in the cooling load.

A further object of the present invention is to provide a variable delivery compressor which is capable of surely changing its cooling capacity in response to a change in the cooling load.

The above and other objects, features and advantages of the present invention will become apparent from the ensuing description of the embodiments illustrated in the accompanying drawings wherein.

Figure 1:
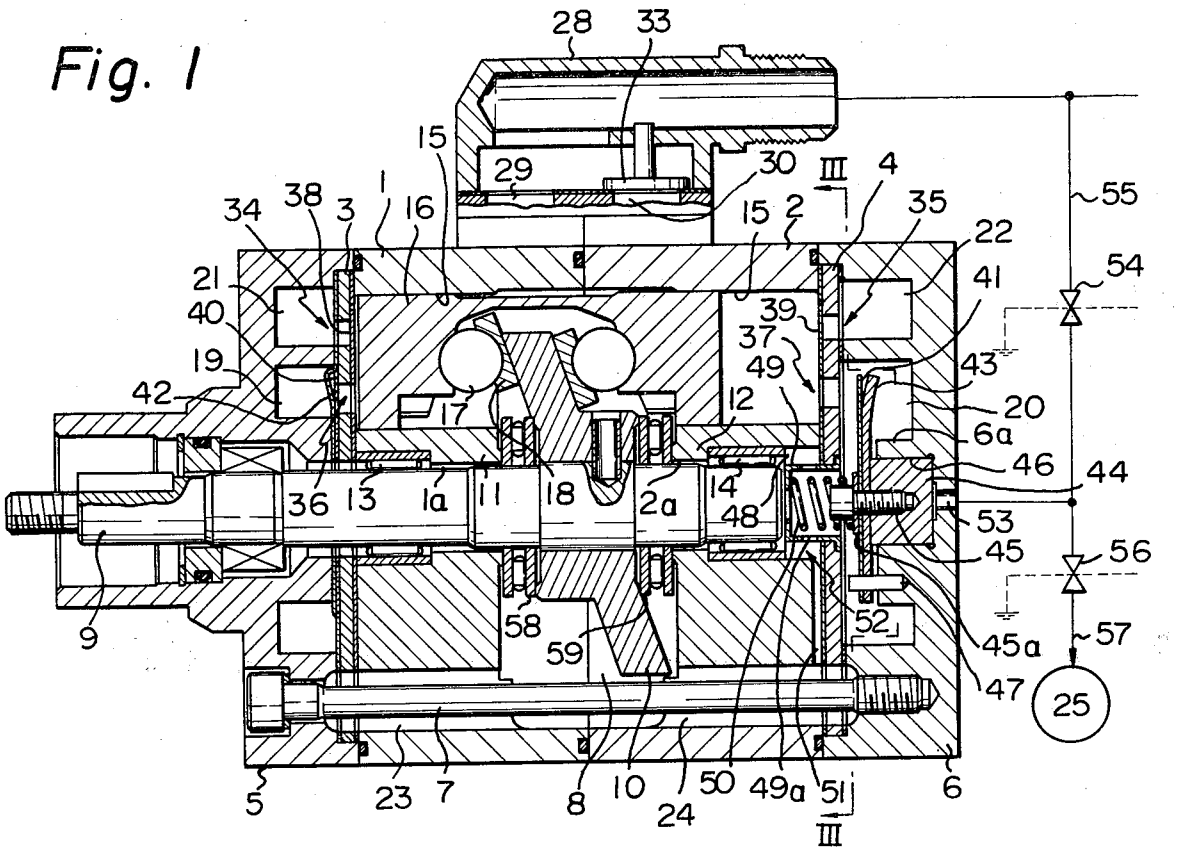
FIG. 1 is a vertical section of a swash plate type compressor according to a first embodiment of the present invention, illustrating one operating state of the compressor.

Referring now to FIGS. 1 through 4 illustrating a double-acting swash plate type compressor of the first embodiment which has ten cylinder bores, five on each side, the compressor has axially connected cylinder blocks 1 and 2 forming a combined cylinder block. The front and rear ends of the combined cylinder block are respectively closed by front and rear housings 5 and 6, via valve plates 3 and 4, respectively. The two cylinder blocks 1 and 2, the two housings 5 and 6 and the two valve plates 3 and 4 are connected together by an appropriate number of screw bolts 7. At the connecting portion of the front and rear cylinder blocks 1 and 2, there is formed a swash plate chamber 8 in which a swash plate 10 secured to a drive shaft 9 is received. The drive shaft 9 axially extends through shaft bores 1*a* and 2*a* which are bored through the center of the connected cylinder blocks 1 and 2. The two cylinder blocks 1 and 2 have boss portions 11 and 12, respectively, in which radial bearings 13 and 14 for rotatably supporting the drive shaft 9 are respectively pressed. Thrust bearings 58 and 59 are interposed between the boss portions 11 and 12 and the swash plate 10, respectively. Each of the cylinder blocks 1 and 2 is formed with five cylinder bores 15 extending parallel with the drive shaft 9 and arranged at five radial positions around the drive shaft 9. The five cylinder bores 15 of the front cylinder block 1 are respectively aligned with the five cylinder bores 15 of the rear cylinder block 2. Double-acting pistons 16 fitted in the cylinder bores 15 are engaged with the swash plate 10 via ball bearings 17 and shoes 18. Due to this engagement, rotation of the swash plate 10 causes reciprocal sliding of the pistons 16 within the cylinder bores 15. Within the front and rear housings 5 and 6, there are formed delivery chambers 19 and 20 arranged in the central portions of the housings 5 and 6, respectively, and substantially annular suction chambers 21 and 22 arranged so as to encircle the respective delivery chambers 19 and 20. The delivery chamber 19 formed in the front housing 5 has the shape of an annular chamber, while the delivery chamber 20 formed in the rear housing 6 has the shape of a substantially circular recessed chamber. The suction chambers 21 and 22 are connected to the swash plate chamber 8 by way of suction passages 23 and 24 which can also act as through-holes through which the screw bolts 7 axially extend. The swash plate chamber 8 per se is fluidly connected to a suction flange 25 which is attached to the outer surface of the connecting portion of the cylinder blocks 1 and 2. Delivery passages 26 and 27 (FIG. 4) are formed in one of the five positions arranged between the neighbouring cylinder bores 15 of the connected cylinder blocks 1 and 2. The passage 26 extends from the surface of the cylinder block 1 which contacts the valve plate 3, toward the connecting portion of the cylinder blocks 1 and 2, while the passage 27 extends from the contacting surface of the cylinder block 2 with the valve plate 4 toward the connecting portion of the cylinder blocks 1 and 2. The two delivery passages 26 and 27 are respectively and fluidly connected to a delivery flange 28 attached to the outer surface of the connecting portion of the two cylinder blocks 1 and 2, via connecting passages 29 and 30, respectively. The delivery passages 26 and 27 are also fluidly connected to the delivery chambers 19 and 20, respectively, via connecting bores 31 and 32 formed in the valve plates 3 and 4, respectively. It should be understood that the delivery chambers 19 and 20 have outwardly extended portions, respectively, which are arranged adjacent to the delivery passages 26 and 27. A valve 33 is arranged so as to open and close the connecting passage 30 which connects the delivery passage 27 of the rear cylinder block 2 and the delivery flange 28. The valve 33 closes the connecting passage 30 when the delivery chamber 20 is kept at a low pressure condition, while the valve 33 is moved so as to open the passage 30 when the delivery chamber 20 is kept at a high pressure condition. Alternately, the valve 33 may be urged toward the opening condition by an appropriate spring. The front and rear valve plates 3 and 4 are respectively bored with suction ports 34 and 35 for connecting the cylinder bores 15 and the suction chambers 21 and 22, respectively, and delivery ports 36 and 37 for connecting the cylinder bores 15 and the delivery chambers 19 and 20, respectively. The suction ports 34 and 35 are provided with suction valves 38 and 39, respectively, and the delivery ports 36 and 37 are provided with delivery valves 40 and 41, respectively. The delivery valves 40 and 41 are deformable. However, the amount of the deforming of the delivery valves 40 and 41 are restricted within respective given limits by valve guards 42 and 43, respectively. The front delivery valve 40 together with the valve guard 42 are attached to the valve plate 3. The rear delivery valve 41 together with the valve guard 43 are movable between a first position where the valve 41 closes the delivery ports 37 and a second position where the valve 41 opens the delivery ports 37. The rear valve guard 43 has the same shape as the rear delivery valve 41, and is provided with an annular base portion 43*a* (FIG. 3) and five reed portions 43*b* (FIG. 3) extending from the annular base portion 43*a* toward respective delivery ports 37. The delivery valve 41 and the valve guard 43 are fixed to a cylindrical spool 44 by means of a screw bolt 45 and a washer 45*a* so that the valve 41, the valve guard 43 and the spool 44 are arranged to be concentric with one another. The spool 44 is axially slidably received in a circular recess 46 which is defined by an inwardly projecting wall 6*a* of the rear housing 6. To the wall 6*a* is fixed a positioning pin 47 which prevents the valve 41 and the valve guard 43 fixed to the spool 44 from being rotated. A cylindrical chamber 48 is provided in the cylinder block 2 so as to be concentric with the shaft bore 2*a*. The cylindrical chamber 48, in which the radial bearing 14 is fitted, receives therein a cylindrical spring holder 49 seated in the valve plate 4. The outer diameter of the spring holder 49 is smaller than the inner diameter of the cylindrical chamber 48. Inside the spring holder 49, there is provided a spring 50 which urges the delivery valve 41 toward its opening position. The spring holder 49 is formed, on both the bottom and the side wall, an appropriate number of small through-holes 49*a* through which the cylindrical chamber 48 is communicated with the inner space of the spring holder 49. The cylindrical chamber 48 is also communicated with the delivery chamber 20 through the through-holes 49*a* of the spring holder 49 when the delivery valve 41 is moved to its opening position. A channel 51 is formed in the end wall of the cylinder block 2 so as to fluidly connect the cylindrical chamber 48 and the suction passage 24. That is, the inner space of the spring holder 49, the small through-holes 49*a* of the spring holder 49 and the channel 51 define a communicating passage 52 through which the delivery chamber 20 communicates with the suction passage 24 when the delivery valve 41 is moved toward its opening position. When the delivery valve 41 is moved to its closing position for closing the delivery port 37, the communication between the delivery chamber 20 and the suction passage 24 is interrupted. A plurality of channels 51 may be provided as occasion requires. Further, the channel or channels 51 may be formed in the end face of the valve plate 4. The suction passage 24, which is connected to the communicating passage 52, should preferably be one of the five passages 24 that is located farthest from the suction flange 25. The rear housing 6 is formed, at its central portion, with a pressure inlet hole 53 which introduces into the circular recess 46 a pressure applied to the rear face of the spool 44. The pressure inlet hole 53 can communicate with the delivery flange 28 by means of a high pressure conduit 55 having therein a first electro-magnetic valve 54, and also can communicate with the suction flange 25 by means of a low pressure conduit 57 having therein a second electro-magnetic valve 56. The opening and closing control of the first and second electro-magnetic valves 54 and 56 is conducted by a pressure switch (not illustrated in FIGS. 1 through 4) which is arranged in a part of the air-conditioning system so as to be operated in response to a change in the temperature of the vehicle compartment. The two electro-magnetic valves 54 and 56 may be replaced with a single switching valve. The high and low pressure conduits 55 and 57 may be provided in a structural element or elements of the compressor per se.

The operation of the swash plate type compressor according to the first embodiment will now be described hereinbelow.

While the compressor is being stopped, the rear delivery valve 41 is moved by the force of the spring 50 toward its opening position, and the valve 33 closes the connecting passage 30 as shown in FIG. 1. Further, the first electro-magnetic valve 54 is opened, and the second electro-magnetic valve 56 is closed. When the clutch is connected and the drive torque is applied to the compressor, the front side of the compressor immediately starts a normal compression operation. However, since the rear delivery valve 37 is opened, and since the delivery chamber 20 communicates with the suction passages 24 through the communicating passage 52, the rear side of the compressor performs no compression operation and idles. That is, in the rear side of the compressor, the refrigerant gas reciprocally flows between the cylinder bores 15 of the rear cylinder block 2 and the delivery chamber 20. Thus, at the start of the operation, the compressor exerts only fifty percent of its full compression. This fact means that the compressor needs only a small starting torque, and that the chance of taking place of the liquid compression can be reduced by half.

At this stage, if an appropriate spring is provided for urging the valve 33 toward its opening position, the front delivery chamber 19 communicates with the suction passages 24 through the connecting passage 30. Thus, the compressor can exert no compression performance immediately after the starting of the operation of the compressor since the compressed gas directly flows into the suction passages 24. However, during the continuation of the operation of the compressor, the compressed gas from the front side of the compressor urges the valve 33 toward its closing position by overcoming the spring force. Therefore, after the closing of the valve 33, the front side of the compressor conducts the normal compression operation, although the rear side of the compressor does not conduct any substantial compression operation. That is, the compressor exerts fifty percents of its full compression. Therefore, if the above-mentioned spring for urging the valve 33 is employed, the starting torque can be smaller than in the case where no spring is provided for urging the valve 33 toward its opening position. Further, liquid compression can be prevented.

Figure 2:
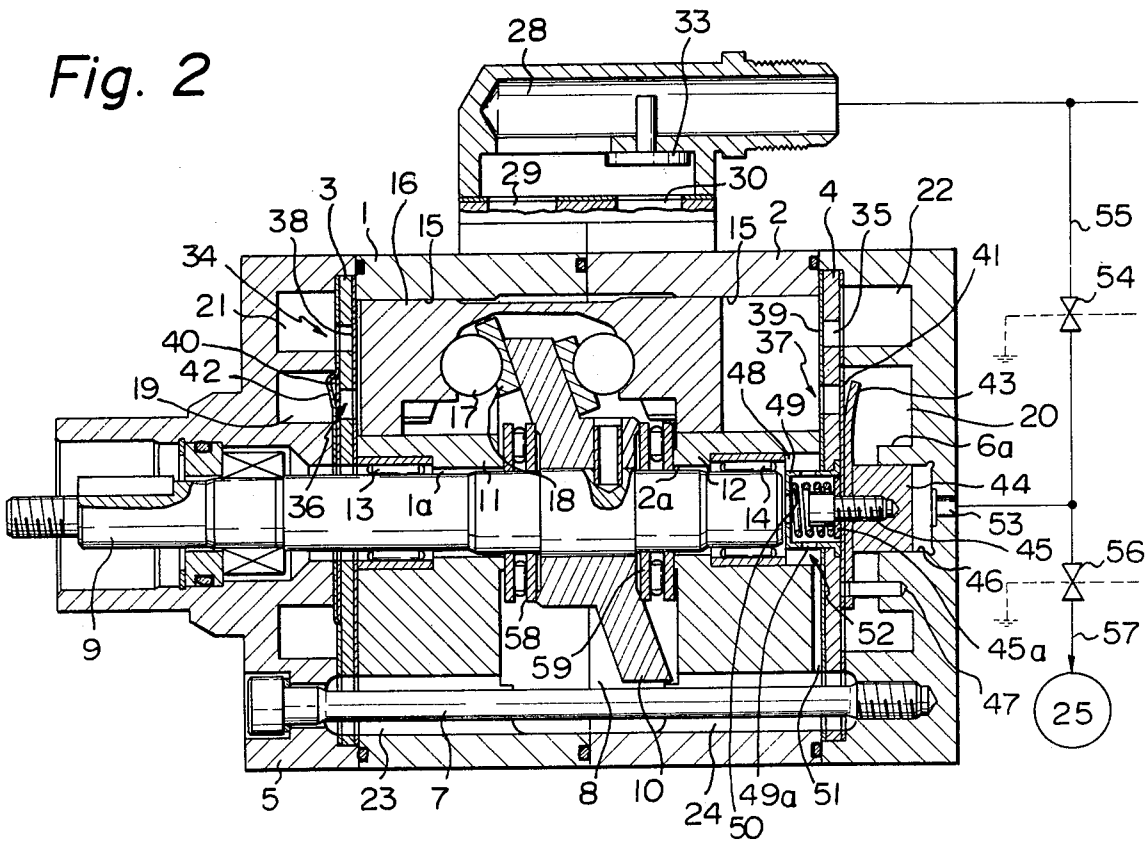
FIG. 2 is the same vertical section of the compressor of FIG. 1, but illustrates another operating state of the compressor.
Figure 3:
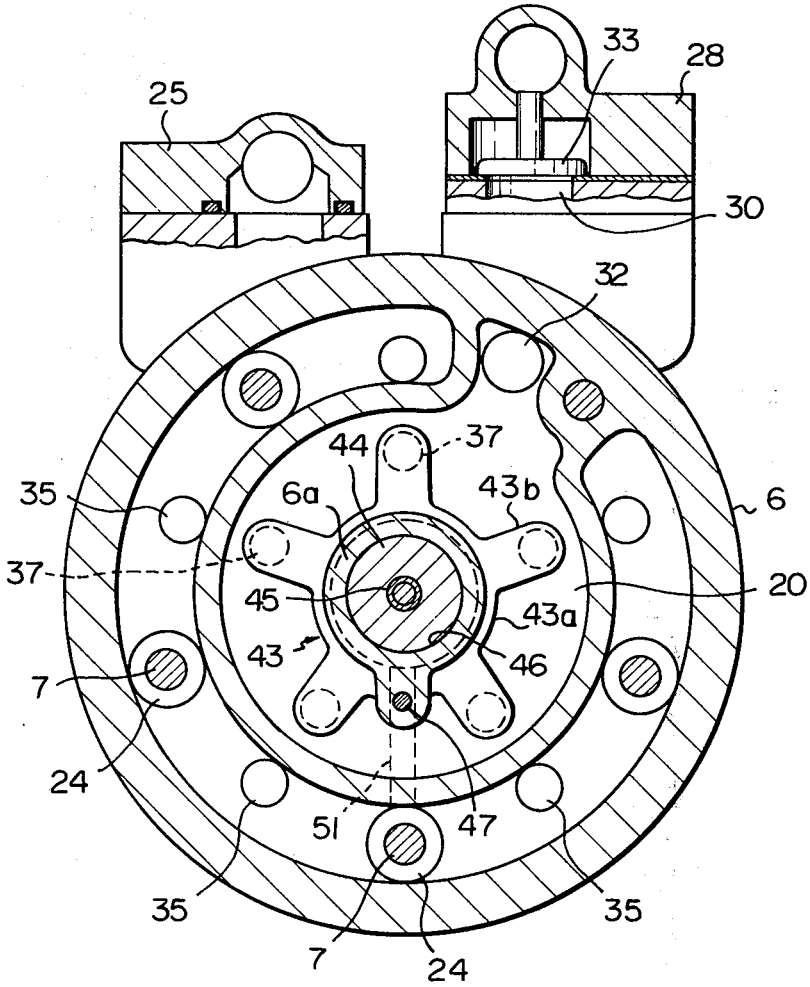
FIG. 3 is a section taken along the line III—III of FIG. 1.
Figure 4:
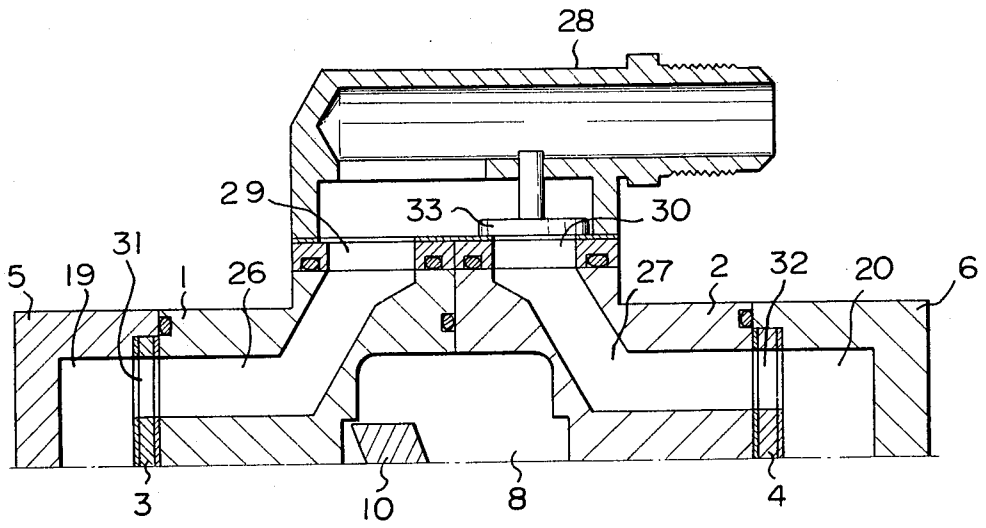
FIG. 4 is a partial vertical section of the compressor of FIG. 1, illustrating delivery passages of a compressed gas.

During the continuation of the compression operation of the front side of the compressor, the compressed gas flows through the delivery flange 28 toward the air-conditioning system. A part of the compressed gas is sent through the high pressure conduit 55 into the pressure inlet hole 53. Thus, the pressure of the compressed gas is applied to the rear end face of the spool 44. At this stage, it should be noted that the first electro-magnetic valve 54 is opened, and that the second electro-magnetic valve 55 is closed. As a result, the rear delivery valve 41 is urged against the spring 50 towards its closing position wherein the valve 41 is pressed against the rear valve plate 4. Thus, the delivery ports 37 are closed, and the communication between the delivery chamber 20 and the suction passages 24 through the communicating passage 52 is interrupted. Accordingly, the rear side of the compressor commences to conduct a normal compression operation. Consequently, the valve 33 closing the connecting passage 30 is pressed toward its opening position by the compressed gas delivered from the rear side of the compressor. As a result, the front and rear sides of the compressor conducts the normal compression operation. That is, the compressor exerts its entire compression performance. FIG. 2 illustrates the state of the compressor where the compressor is running while exerting the entire compression performance.

While the cooling load applied to the air-conditioning system of the vehicle is considerably large, the operation of the compressor is continued so as to exert full compression. Thus, the temperature of the vehicle compartment is gradually lowered.

During the continuation of the operation of the compressor, when the temperature is lowered to a predetermined value and when the cooling load applied to the air-conditioning system is reduced to a predetermined limit, the pressure switch becomes ON, so that the first electro-magnetic valve 54 is closed, and the second electro-magnetic valve 56 is opened. Therefore, a low pressure of the refrigerant gas coming from the suction flange 25 acts on the rear end face of the spool 44. As a result, the rear delivery valve 41 is moved by the force of the spring 50 against the low pressure of the refrigerant gas toward the opening position. Thus, the rear delivery port 37 is opened. Accordingly, the compression operation of the rear side of the compressor becomes ineffective. That is, the operation of the compressor is switched to the state where the compressor exerts a half (fifty percent) of its full compression performance.

It should be here noted that the valve 33 is urged toward its closing position by the pressure of the compressed gas delivered from the front side of the compressor. Therefore, the entire compressed gas delivered from the front side of the compressor flows into the delivery flange 28. That is, the leakage of the compressed gas from the front side to the rear side is prevented by the valve 33.

At this stage, it should be understood that when the compressor is running while exerting the full compression performance, the refrigerant gas flows at a high speed within the suction passages 24. Therefore, the pressure of the gas in the suction passages 24 is lower than that of the gas in the shaft bore **2*a*. As a result, a part of the refrigerant gas flowing from the suction flange 25 into the swash plate chamber 8 further flows into the suction passages 24 while passing through a gap of the thrust bearing 59, the shaft bore 2*a*, the radial bearing 14, the cylindrical chamber 48 and the channel 51. Thus, the radial bearing 14 is lubricated by an oil suspended in the flowing refrigerant gas. It should further be understood that when the compressor is running while exerting fifty percents of its full compression, the flow of the refrigerant gas from the delivery chamber 20 into the swash plate chamber 8 appears while passing through the through-holes 49*a* of the spring holder 49, the cylindrical chamber 48, the radial bearing 14 and the shaft bore 2a, because the delivery valve 41 is moved to its opening position, and because the pressure of the refrigerant gas in the delivery chamber 20 is slightly higher than that of the gas in the swash plate chamber 8. Therefore, the radial bearing 14** on the rear side is lubricated by an oil suspended in the flowing refrigerant gas.

Figure 5:
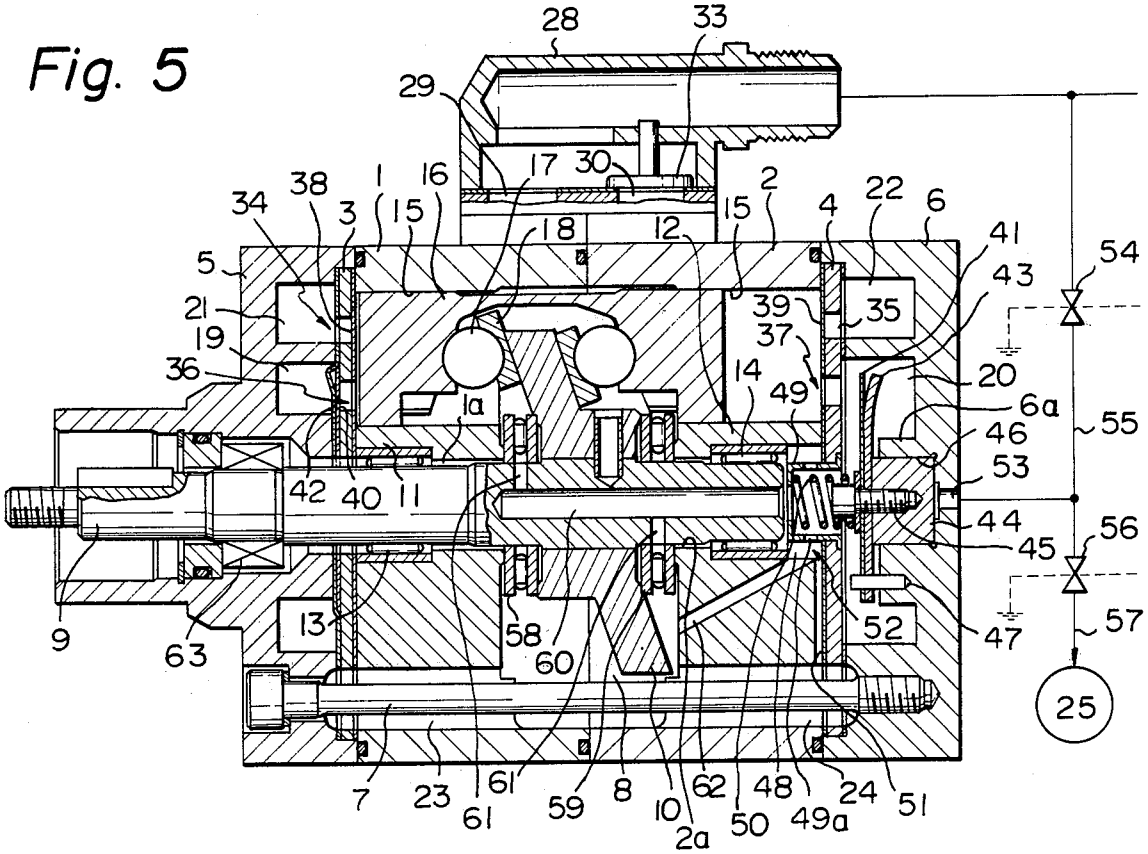
FIG. 5 is vertical section of a swash plate type compressor according to a second embodiment of the present invention.
Figure 6:
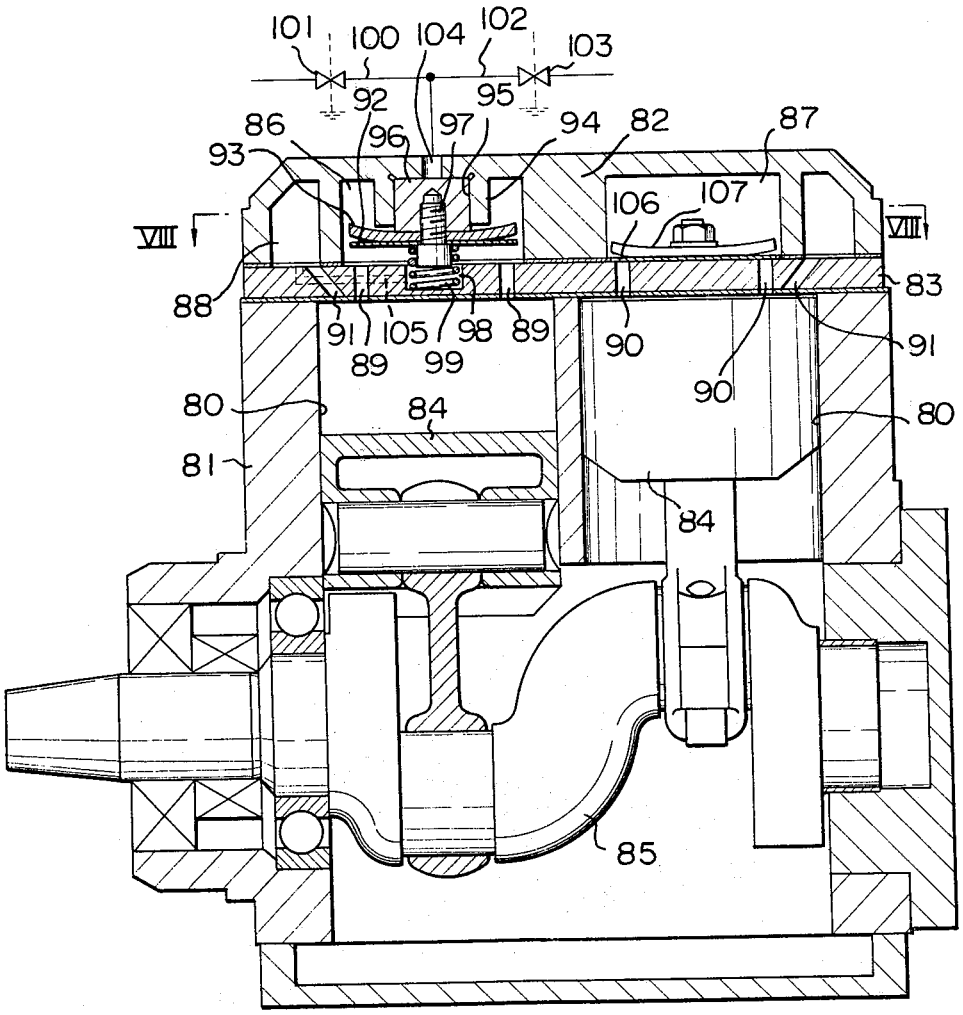
FIG. 6 is a vertical section of crankshaft type compressor according to a third embodiment of the present invention, illustrating one operating state of the compressor.
Figure 7:
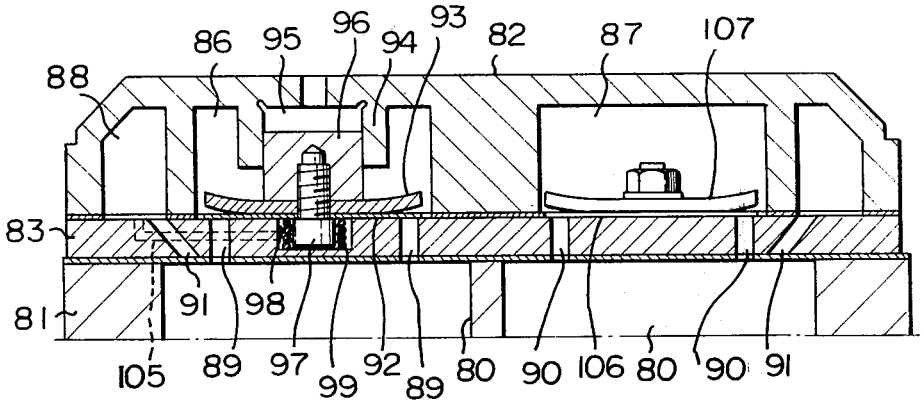
FIG. 7 is a partial vertical section of the compressor of FIG. 6, illustrating another operating state of the compressor.
Figure 9:
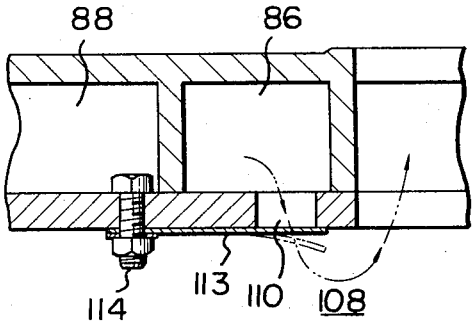
FIG. 9 is a section taken along the line IX—IX of FIG. 8.
Figure 8:
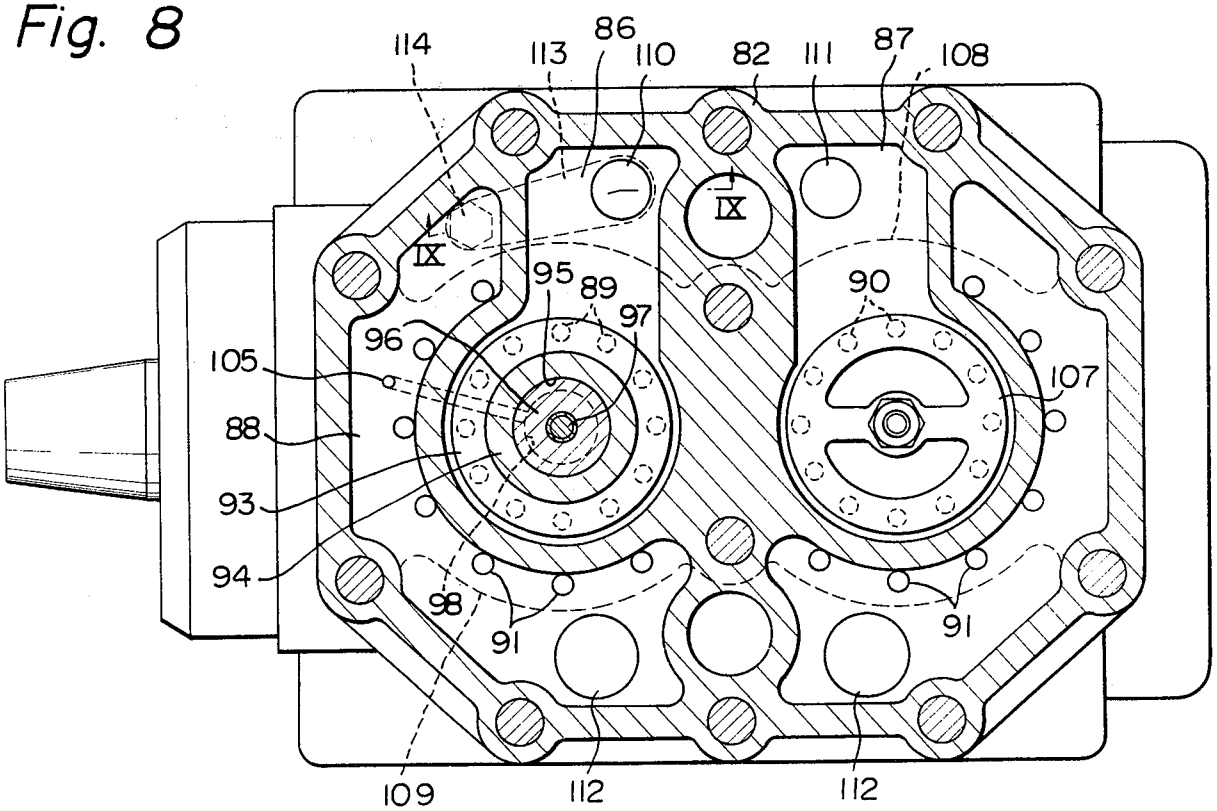
FIG. 8 is a section taken along the line VIII—VIII of FIG. 6.

Referring to FIG. 5 illustrating the swash plate type compressor according to the second embodiment of the present invention, this compressor is different from that of the first embodiment in that the drive shaft 9 is formed with an axial bore 60 extending from the rear end of the shaft into a position adjacent to the front thrust bearing 58 and two radial bores 61 radially extending from the axial bore 60 to the front and rear thrust bearings 58 and 59. Due to this difference, when the compressor is running while exerting a half of its full compression performance, the refrigerant gas in the rear delivery chamber 20 is introduced toward the front and rear thrust bearings 58 and 59 by way of the axial bore 60 and the radial bores 61, since the rear delivery valve 41 is moved to its opening position. Therefore, the thrust bearings 58 and 59 are lubricated with certainty by an oil suspended in the introduced refrigerant gas. If occasion arises, the axial bore 60 may be extended to a position adjacent to a sealing device 63, so that the refrigerant gas suspending therein an oil component is introduced toward the sealing device 63. In the compressor of the second embodiment, a relief bore 62 is provided in the rear cylinder block 2, so that the cylindrical chamber 48 communicates with the swash plate chamber 8 by way of the relief bore 62. This relief bore 62 contributes to prevent the pressure in the delivery chamber 20 from becoming excessive when the rear side of the compressor exerts no substantial compression performance.

FIGS. 6 through 9 illustrate a crankshaft type compressor according to a third embodiment of the present invention. The compressor of the present embodiment has two cylinder bores 80 formed in a cylinder block or crank casing 81. A housing or top head 82 is mounted on the top end of the cylinder block 81 via a valve plate 83. Within the cylinder bores 80, reciprocal pistons 84 are fitted so that the reciprocating motion of the two pistons 84 is caused due to the rotation of a crankshaft 85. The housing 82 has therein a front and a rear delivery chamber 86 and 87, and a suction chamber 88 arranged so as to encircle both delivery chambers 86 and 87. The front delivery chamber 86 communicates with the frontal cylinder bore 80 by way of a plurality of delivery ports 89, and the rear delivery chamber 87 communicates with the rear cylinder bore 80 by way of a plurality of delivery ports 90. The suction chamber 88 communicates with both front and rear cylinder bores 80 by way of a plurality of suction ports 91. A front delivery valve 92 for opening and closing the delivery ports 89 and a valve guard 93 are fixed to a spool 96 by means of a screw bolt 97. The spool 96 is slidably fitted in a cylindrical recess 95 which is defined by a circular wall 94. The front delivery valve 92 together with the valve guard 93 and the spool 96 are urged toward an opening position by a spring 99 which is seated in the bottom of a round recess 98 formed in the valve plate 83. A pressure inlet hole 104 formed in the housing 82 is provided for introducing into the cylindrical recess 95 a pressure acting on the spool 96 via a high pressure conduit 100 having a first electro-magnetic valve 101 or a low pressure conduit 102 having a second electro-magentic valve 103. When the first electro-magnetic valve 101 is opened, a high pressure is introduced into the cylindrical recess 95. Therefore, the front delivery valve is moved toward a closing position against the force of the spring 99. On the other hand, when the first electro-magnetic valve 101 is closed and the second electro-magnetic valve 103 is opened, a low pressure is introduced into the cylindrical recess 95. Therefore, the front delivery valve 92 is moved back to the opening position by the force of the spring 99. This movement of the front delivery valve 92 is based on the same principle as that of the rear delivery valve 41 of the first and second embodiments. At this stage, it should be noted that the valve plate 83 is formed with a communicating passage 105 for establishing a fluid communication between the round recess 98 and the suction chamber 88. Therefore, when the delivery valve 92 is moved to its opening position, the front delivery chamber 86 is fluidly connected to the suction chamber 88 by way of the communicating passage 105. A rear delivery valve 106 and a valve guard 107 are fixed to the valve 83 so as to close the rear delivery ports 90. The rear delivery valve 106 is deformable so as to open the delivery ports 90. The cylinder block 81 is formed with an auxiliary delivery chamber 108, and an auxiliary suction chamber 109. The auxiliary delivery chamber 108 communicates with the front and rear delivery chambers 86 and 87 via communicating holes 110 and 111, respectively. The auxiliary suction chamber 109 communicates with the suction chamber 88 via communicating holes 112. A reed valve 113 for closing the communicating hole 110 is fixed to the cylinder block 81 by means of a screw bolt 114. The reed valve 113 is opened due to a delivery pressure delivered from the front delivery chamber 86 when the compressor is running while exerting its full compression.

The compressor of the third embodiment of the present invention operates in a similar manner to the compressor of the first embodiment. Therefore, at the initial start of the compressor, the front side of the compressor exerts no substantial compression and only the rear side of the compressor exerts its full compression, since the front delivery valve 92 is initially moved to its opening position. That is, at the initial stage of the operation of the compressor, the compressor runs while exerting fifty percent of its full compression. Thereafter, when the front delivery valve 92 is moved to its closing position due to a high pressure coming from the high pressure conduit 100 and acting on the spool 96, both the front and rear sides of the compressor together perform their compression operation. As a result, the compressor runs while exerting a hundred percent of its full compression. This fact means that the compressor can be started by the application of a considerably small torque to the compressor. Further, no appreciable liquid compression takes place.

On the other hand, when the compressor is continually running, the compression performance exerted by the compressor of the present embodiment is switched from the hundred percent state to the fifty percent state and vice versa in response to a change in the cooling load applied to the associated air-conditioning system. This fact is very advantageous for achieving an economical operation of the compressor. In addition, no frequent connection and disconnection of the clutch that is arranged between a vehicle engine system and the compressor takes place when the cooling load is low. Accordingly, the long life of the clutch is guaranteed. Moreover, when the compressor runs while exerting a half of its full compression, the front delivery chamber 86 communicates with the suction chamber 88 by way of the communicating passage 105. Therefore, the pressure prevailing in the front delivery chamber 86 is always kept constant and low. Accordingly, generation of mechanical vibration and noise can be prevented, and the life of the compressor can be long.

Figure 10:
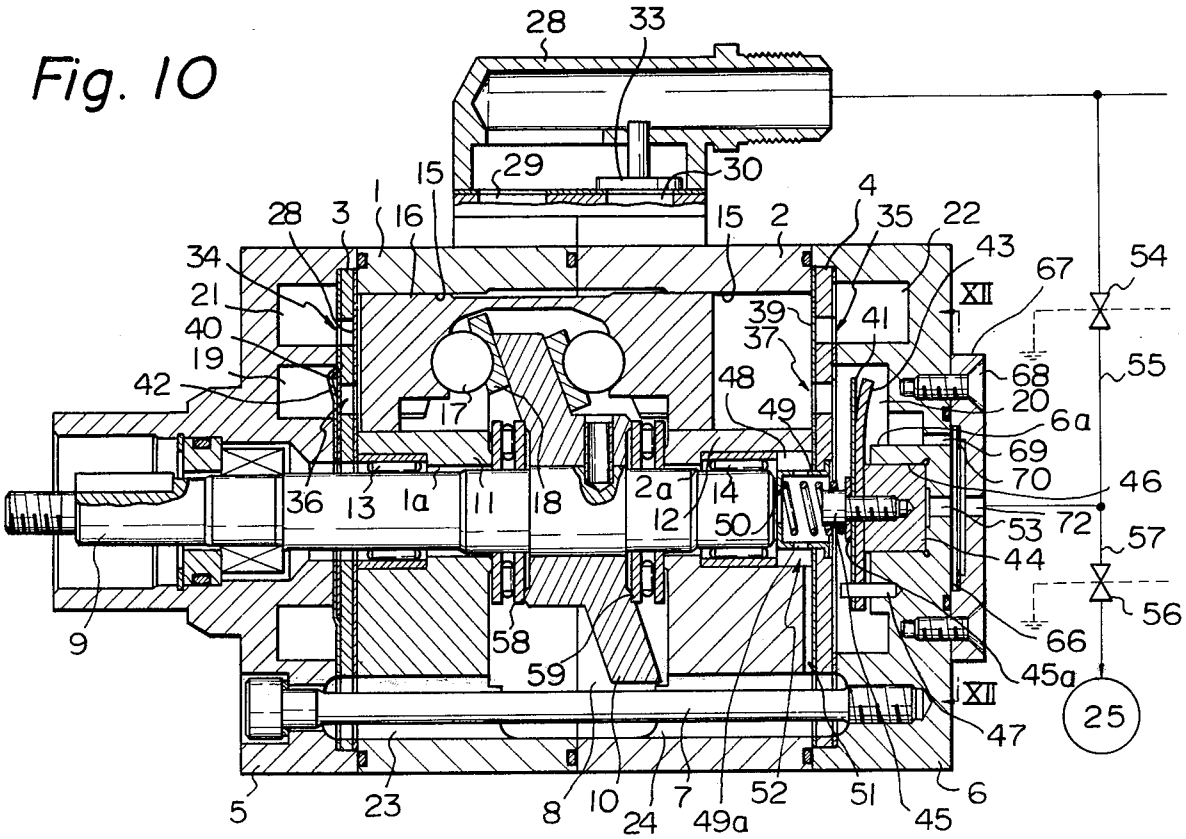
FIGS. 10 and 11 are vertical sections of a swash plate type compressor, respectively, according to a fourth embodiment of the present invention.
Figure 11:
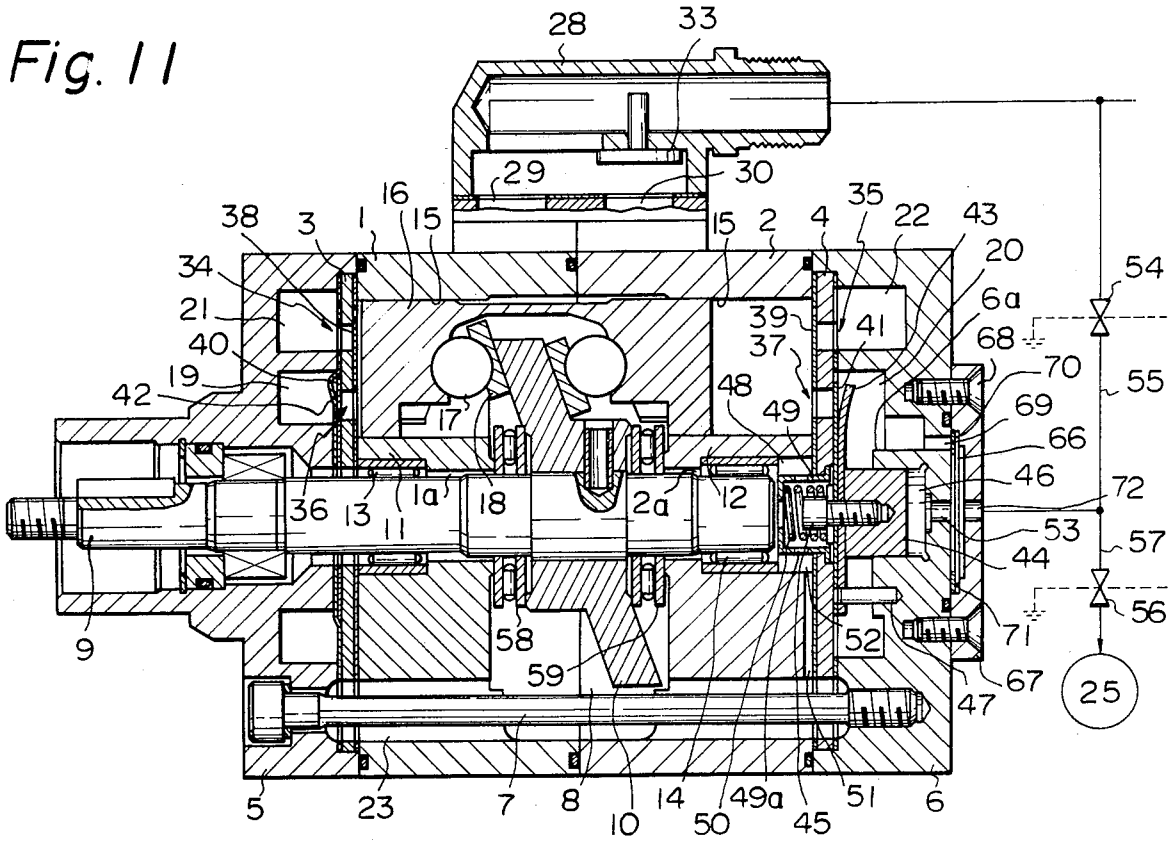
Figure 12:
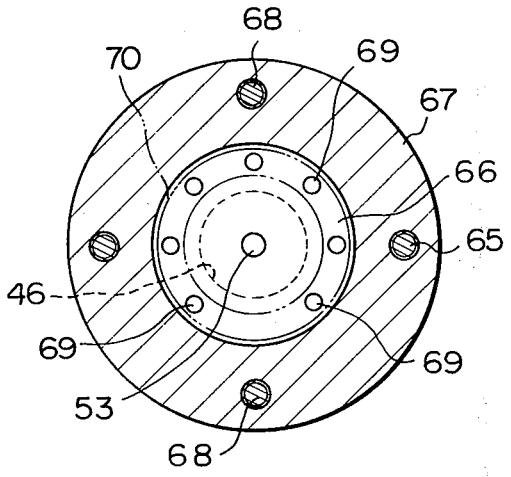
FIG. 12 is a section taken along the line XII—XII of FIG. 10.

FIGS. 10 through 12 illustrate a swash plate type compressor according to a fourth embodiment of the present invention. It will be understood from FIGS. 10 and 11 that a large part of the construction and arrangement of the compressor according to the present embodiment is the same as that of the compressor of the first embodiment illustrated in FIGS. 1 through 4. Therefore, the same or like elements are designated by the same reference numerals as those of the first embodiment. The description will be provided below with respect to the difference of the present embodiment from the first embodiment, reference being made to FIGS. 10 through 12.

In the compressor of the present fourth embodiment, a covering 67 is fixed to the rear end face of a rear housing 6 by means of a plurality of screw bolts 68. The covering 67 is formed therein with a circular recess 66 which is arranged to be concentric with a circular recess 46 of the rear housing 6. The circular recesses 46 and 66 will hereinafter be referred to as a first and a second recess, respectively. The central part of the second recess 66 communicates with the first recess 46 by way of a pressure inlet hole 53, while the outer peripheral part of the second recess 66 communicates with a rear delivery chamber 20 by way of a plurality of relief holes 69 formed in the rear housing 6. Within the second recess 66, there is incorporated an annular shaped check valve 70 for opening and closing the relief holes 69. The check valve 70 bears against an annular seat 71 which is formed in the covering 67 when the valve 70 is moved to its opening position. It should be noted that the inner diameter of the annular check valve 70 is smaller than that of the annular seat 71. The check valve 70 may be urged toward its closing position by an appropriate spring, if the force of the spring is easily overcome by the pressure of the compressed refrigerant gas in a rear delivery chamber 20 when the rear side of the compressor performs its normal compression operation. The covering 67 is formed, at its central portion, with a pressure inlet hole 72 for introducing into the second recess 66 a pressure coming from a high pressure conduit 55 connected to a delivery flange 28 or a low pressure conduit 57 connected to a suction flange (not shown in FIGS. 10 through 12) which is the same as the flange 25 of the first embodiment.

The above-described difference of the construction and arrangement of the present embodiment from those of the first embodiment brings about such an advantage that when the cooling load decreases below a predetermined limit, the compression performance exerted by the compressor of the present embodiment can be immediately switched from a hundred percent state to fifty percent state with certainty. The reason will now be described below.

When the compressor runs exerting full compression and when the cooling load decreases below a predetermined limit, a first electro-magnetic valve 54 in the high pressure conduit 55 is closed and a second electro-magnetic valve 56 in the low pressure conduit 57 is opened, so that a low pressure is introduced into the second recess 66 of the covering 67 as well as the first recess 46 of the housing 6 via pressure inlet holes 72 and 53. Thus, the low pressure acts on a spool 44, and the rear delivery valve 41 is moved to its opening position by the force of a spring 50. At this stage, the low pressure also acts on the check valve 70. Therefore, the check valve 70 is immediately moved to its opening position. As a result, a high pressure refrigerant gas in the rear delivery chamber 20 leaks through the relief holes 69 into the second recess 66, and the pressure in the delivery chamber 20 is lowered. Accordingly, the delivery valve 41 can rapidly and surely be moved to its opening position by the force of the spring 50. Also, a valve 33 closes a connecting passage 30 as soon as the pressure in the rear delivery chamber 20 is lowered. Consequently, the compression performance exerted by the compressor is rapidly switched from a hundred percent state to a fifty percent state with certainty. It should be understood that FIG. 10 illustrates a state where the compressor runs exerting a half of the entire compression performance and that FIG. 11 illustrates a state where both front and rear sides of the compressor perform their compression operation.

Figure 13:
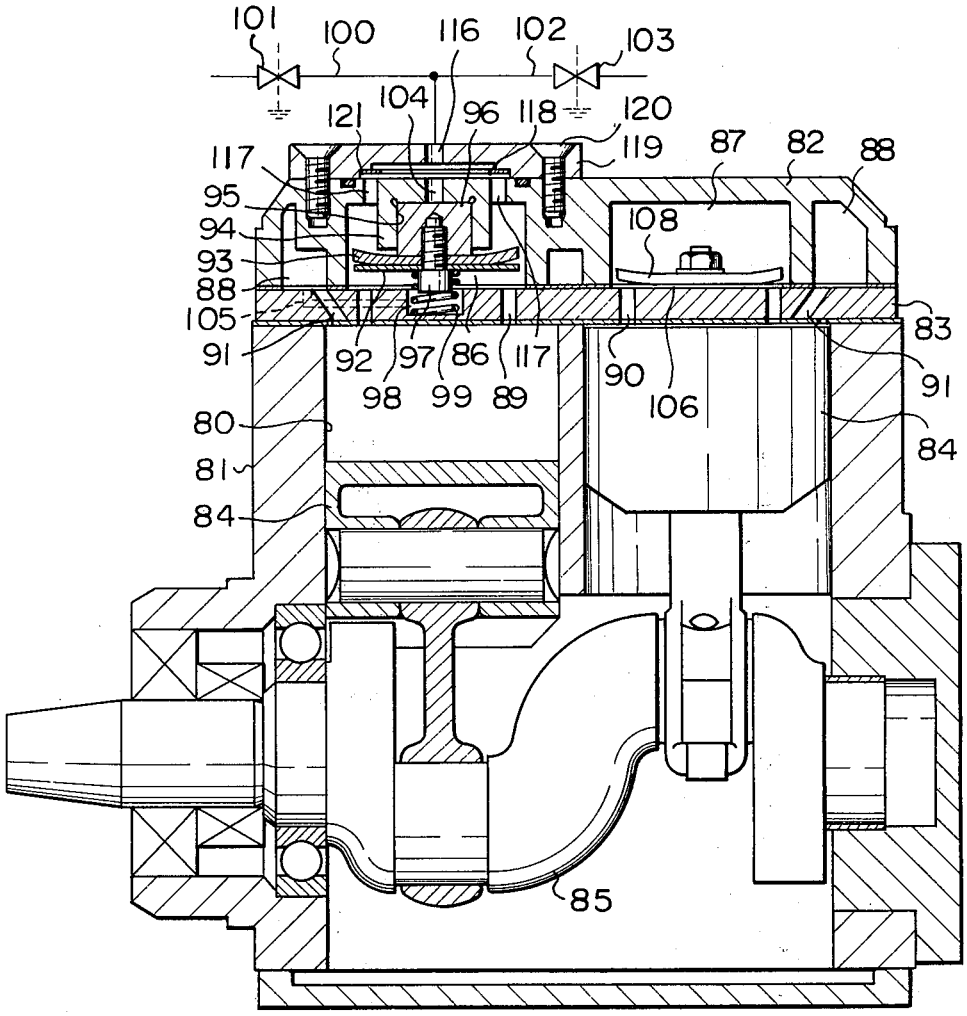
FIG. 13 is a vertical section of a crankshaft type compressor, according to a fifth embodiment of the present invention.
Figure 14:
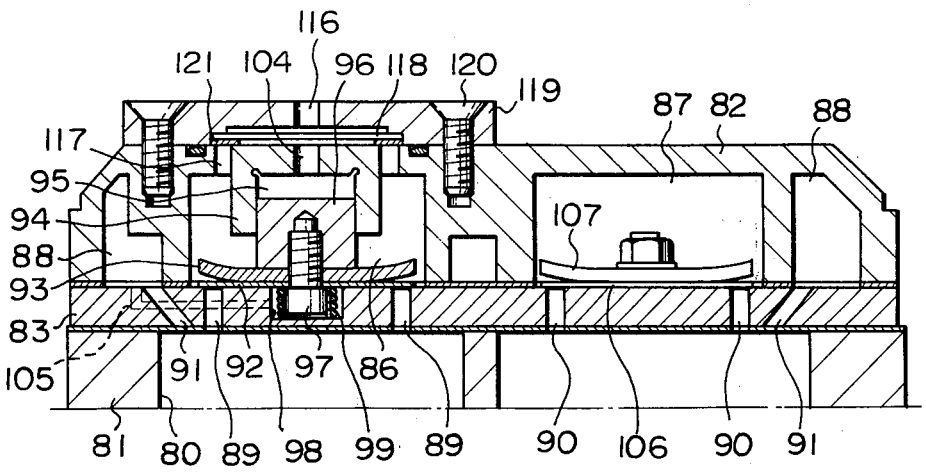
FIG. 14 is a partial vertical section of the compressor of FIG. 13, illustrating a different operating state from that illustrated in FIG. 13.

FIGS. 13 and 14 illustrates a crankshaft type compressor according to a fifth embodiment of the present invention. A large part of the construction and arrangement of this compressor is the same as that of the crankshaft type compressor of the third embodiment illustrated in FIGS. 6 through 9. Thus, the same elements are designated by the same reference numerals as those of the third embodiment. The difference of the fifth embodiment from the third embodiment resides in that this compressor of the fifth embodiment has a covering 119 fixed to the top of the front portion of a housing 82 by means of screw bolts 120. The covering 119 has therein a cylindrical recess 118 communicating with a cylindrical recess 95 of the housing 82 by way of a pressure inlet hole 104 of the housing 82. The cylindrical recess 118 of the covering 119 also communicates with a front delivery chamber 86 by way of a plurality of relief holes 117. Within the cylindrical recess 118, there is provided a check valve 121 which is operable to open and close the relief holes 117. The covering 119 is formed with a pressure inlet hole 116 for introducing into the cylindrical recess 118 a pressure coming from a high pressure conduit 100 connected to the delivery line of the compressor or a low pressure conduit 102 connected to the suction line of the compressor. When a first electro-magnetic valve 101 in the high pressure conduit 100 is opened and when a second electro-magnetic valve 103 in the low pressure conduit 102 is closed, a high pressure acts on a spool 96, so that the front delivery valve 92 is moved to its closing position against a spring 99. On the contrary, when the first electro-magnetic valve 101 is closed, and when the second electro-magnetic valve 103 is opened, a low pressure acts on the spool 96, so that the front delivery valve 92 is moved to its opening position by the force of the spring 99. It should be understood that the operation of the compressor of the fifth embodiment is quite similar to that of the compressor of the third embodiment. However, due to the provision of the check valve 121 which only permits the flow of the refrigerant gas from the front delivery chamber 86 to the cylindrical recess 118 by way of the relief holes 117, the switching of the front delivery valve 92 from the closing position to the opening position can be immediately and surely carried out in response to a change in the pressure acting on the spool 96. This fact brings about the same advantage as that brought about by the compressor of the fourth embodiment.

FIGS. 15 through 18 illustrate a swash plate type compressor according to a sixth embodiment of the present invention. The compressor of the present embodiment should be understood as a modification of the compressor of the first embodiment illustrated in FIG. 1 through 4. In the compressor of the present sixth embodiment, the rear cylinder block 2 is formed with no channel for fluidly connecting the rear delivery chamber 20 an the suction passages 24. In the bottom of cylindrical chamber 48 of the rear cylinder block 2, a cap-like spring holder 49' having a through-hole 75 is fitted. The bottom of the spring holder 49' bears against the end face of the radial bearing 14, and the open end of the spring holder 49' abuts against the rear valve plate 4. The spring 50 seated in the spring holder 49' extends through a round bore 74 of the valve plate 4 toward the rear delivery valve 41, and urges said valve 41 toward the opening position thereof. It should be noted that the diameter "$D_2$" of the round bore 74 is smaller than the diameter "$D_1$" of the spool 44' to which the rear delivery valve 41 and the valve guard 43 are fixed by means of the screw bolt 45 and the washer **45*a*. The spool 44' has on its front side a smaller diameter portion. The through-hole 75 of the spring holder 49' permits the flow of the refrigerant gas from the rear delivery chamber 20 to the swash plate chamber 8 by way of the round bore 74 and the shaft bore 2*a*, when the rear delivery valve 41 is moved to its opening position. The circular recess 46 of the rear housing 6 is supplied with a pressure by way of a pressure inlet hole 53 and a pressure conduit 77 which communicates with the suction flange 25 and the delivery flange 28, via a switching valve 76. In response to the operation of the switching valve 76, the communication between the cylindrical recess 46 and the delivery flange 28 is switched to the communication between the cylindrical recess 46 and the suction flange 25 and vice versa. Thus, the pressure acting on the rear end face of the spool 44' is switched from a high delivery pressure to a low suction pressure and vice versa. The operation of the switching valve 76** can be controlled by the pressure switch stated in the description of the first embodiment.

With the above-described construction and arrangement of the compressor of the sixth embodiment, the general operation of the compressor is the same as that of the compressor of the first embodiment. However, the movement of the rear delivery valve 41 of the present embodiment is different from that of the delivery valve 41 of the first embodiment. A description will now be provided as to how the delivery valve 41 fixed to the spool 44' is moved from its closing position to its opening position while referring to FIG. 18.

Figure 15:
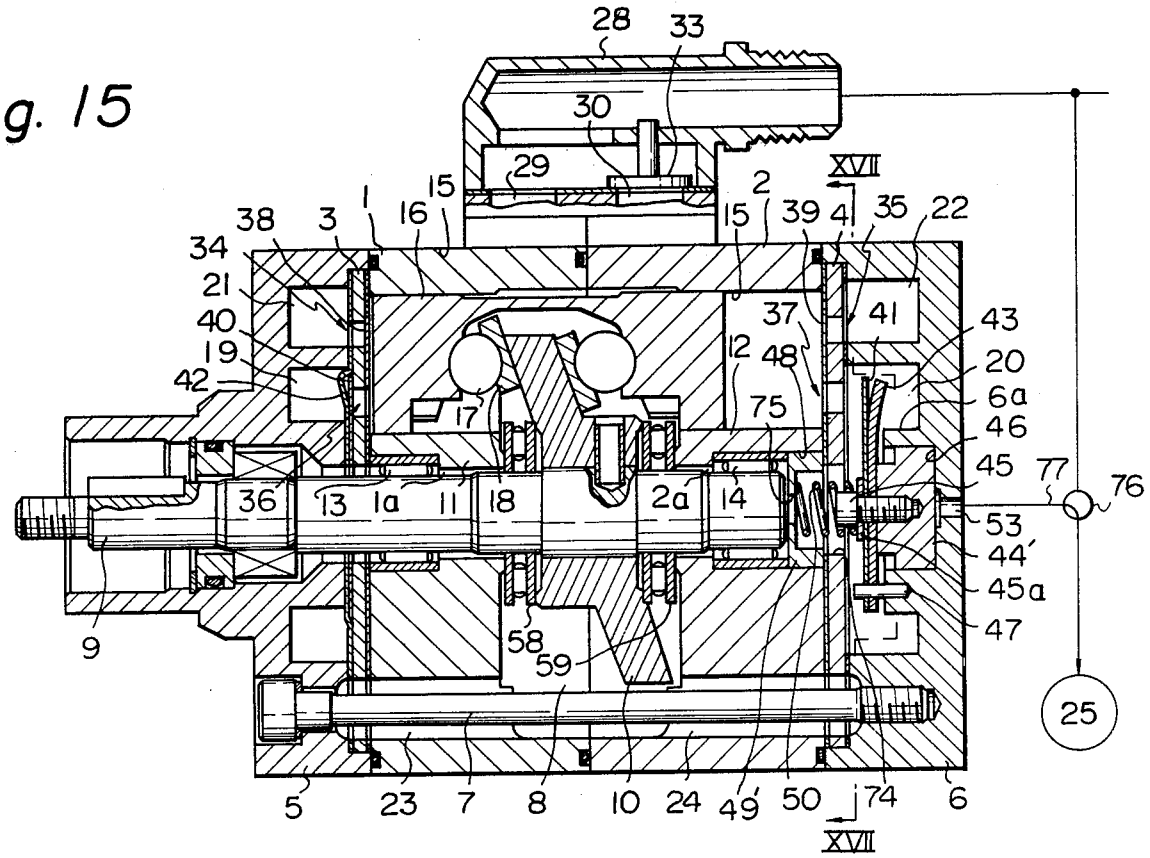
FIGS. 15 and 16 are vertical sections of a swash plate type compressor, respectively, according to a sixth embodiment of the present invention.
Figure 16:
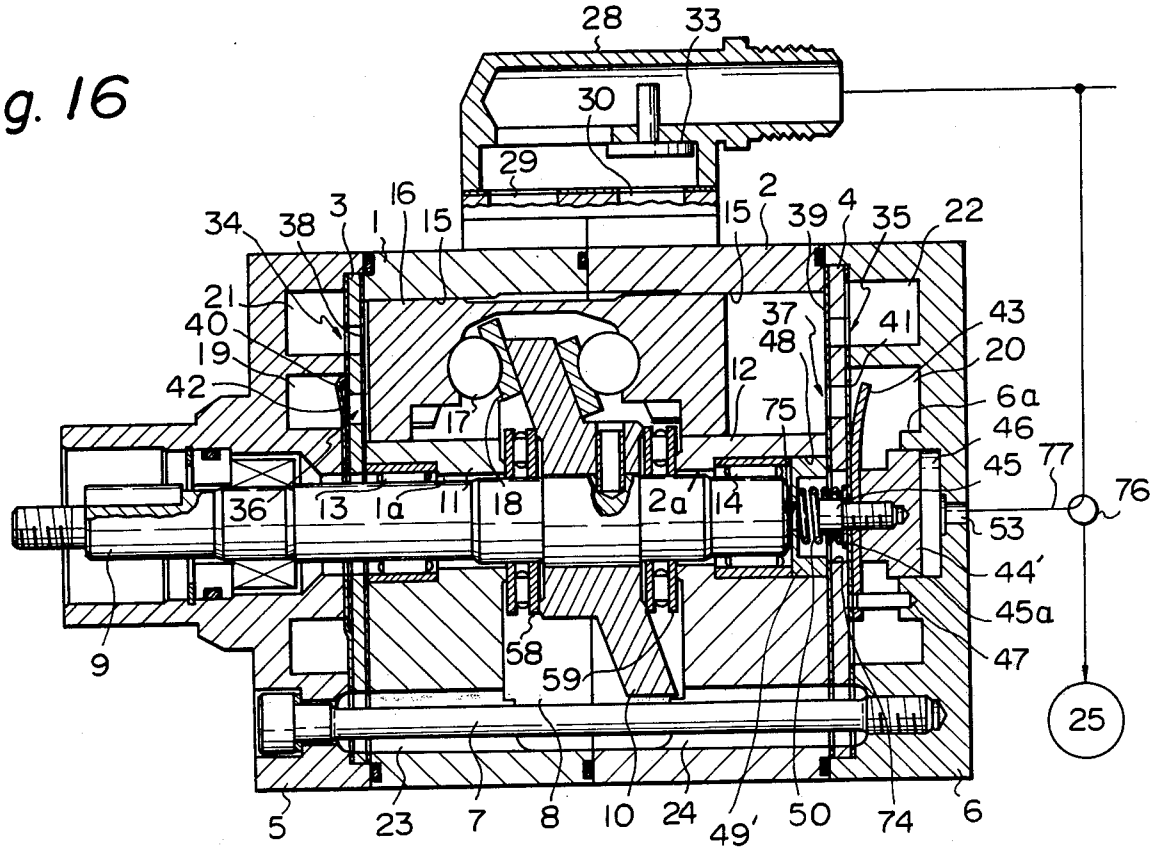
Figure 17:
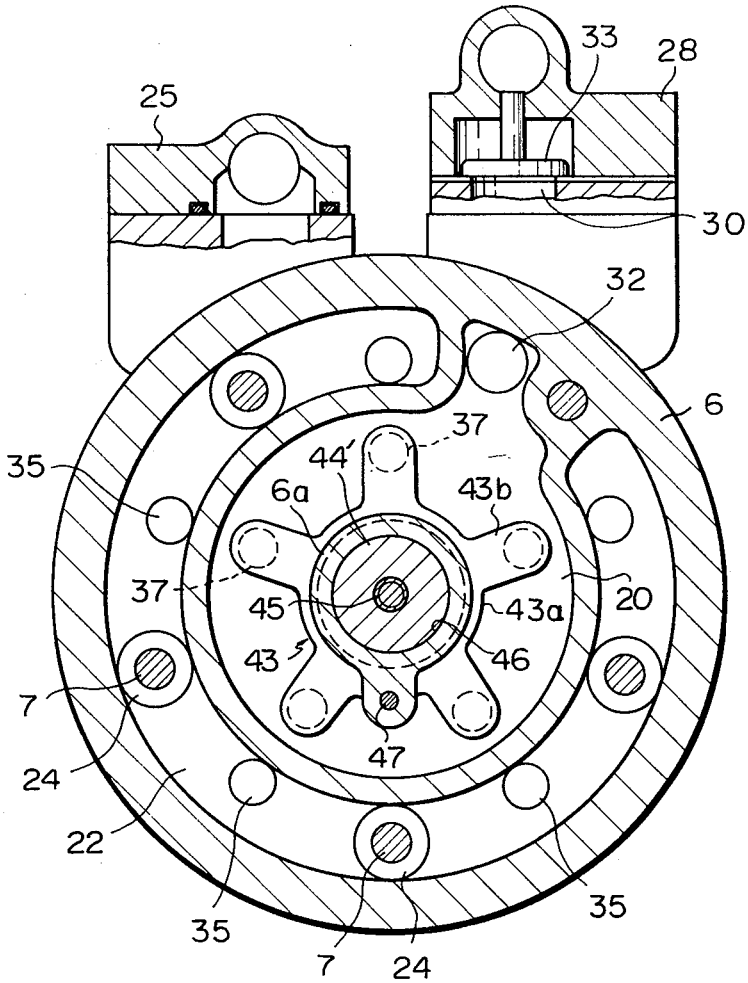
FIG. 17 is a section taken along the line XVII—XVII of FIG. 15.
Figure 18:
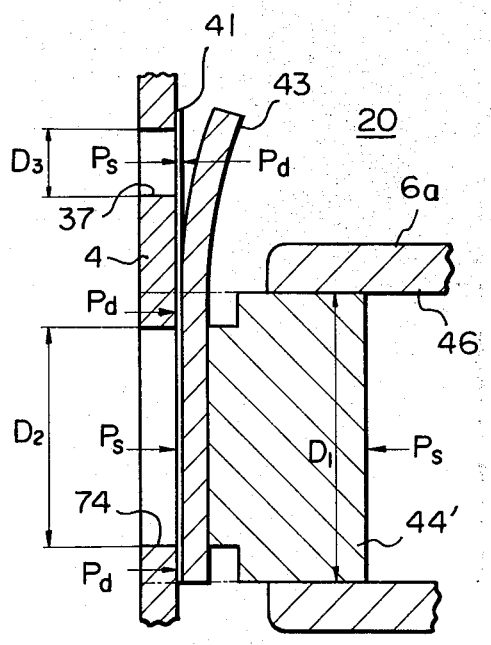
FIG. 18 is a partial sectional view of a rear delivery valve and a spool employed for the compressor of FIG. 15.

During the continuous running of the compressor, when the pressure acting on the rear end face of the spool 44' is switched by the switching valve 76 (FIGS. 15 and 16) from a high delivery pressure "$P_d$" to a low suction pressure "$P_s$", the pressure in the rear delivery chamber 20 is kept at "$P_d$". The pressure prevailing in the delivery port 37 and the round bore 74 of the valve plate 4 is "$P_s$". Thus, the force acting on the rear end face of the spool 44' is $P_s \cdot S_1$, where $S_1$ is equal to $(\pi/4)D_1^2$. On the other hand, the force acting on the front end face of the spool 44' is $P_s \cdot S_2 + P_d \cdot A + F$, where $S_2$ is equal to $(\pi/4)D_2^2$, A is equal to $(\pi/4)(D_1^2 - D_2^2)$, and F is the force of the spring 50 (FIGS. 15 and 16). Therefore, the spool 44' is subjected to the force $P_1$ which is equal to $(P_d - P_s) \cdot (\pi/4)(D_1^2 - D_2^2) + F$. This force $P_1$ acts so as to move the spool 44' away from the valve plate 4.

The force $P_2$ acting on the delivery valve 41 is defined as follows. $P_2 = (P_d - P_s) \cdot (\pi/4)\ D_3^2 \cdot N$, where $D_3$ indicates the diameter of each delivery port 37, and N is the number of cylinder bores which are subjected to the suction operation. That is, in the case of the present embodiment having five cylinder bores on each of the front and rear sides, N is equal to three. The force $P_2$ acts so as to press the delivery valve 41 against the valve plate 4. As a result, if $(\pi/4)\ (D_1^2 - D_2^2)$ is approximately equal to $(\pi/4)D_3^2 \cdot N$, the force F of the spring 50 for moving the delivery valve 41 from its closing position to its opening position can be extremely small. Further, if $(\pi 4)(D_1^2 - D_2^2)$ is larger than $(\pi 4)D_3^2 \cdot N$, the force F of the spring 50 can be zero. That is to say, the delivery valve 41 can be moved from its closing position to its opening position without provision of the spring 50. At this stage, it should be understood that $(\pi/4)(D_1^2 - D_2^2)$ corresponds to the area of an annular surface portion of the spool 44', which portion acts as a pressure receiving surface.

The above-mentioned principle of the movement of the delivery valve 41 is applicable to a crankshaft type compressor according to the third embodiment of the present invention illustrated in FIGS. 6 through 9.

Figure 19:
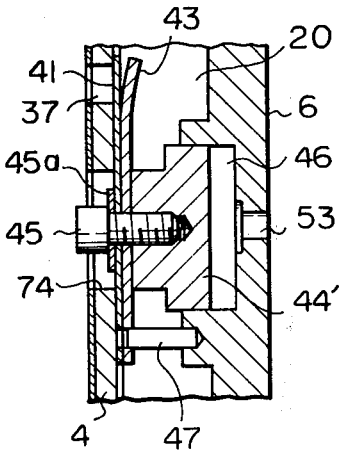
FIGS. 19 through 21 are partial sectional views illustrating an improvement of a delivery valve employed in a swash plate type compressor of the present invention.
Figure 20:
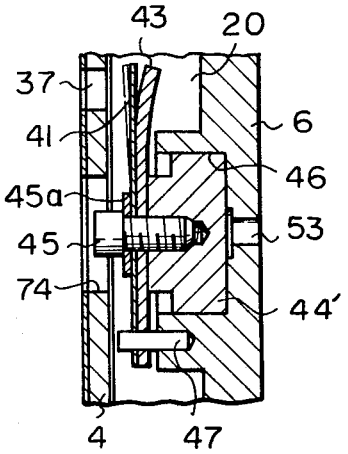
Figure 21:
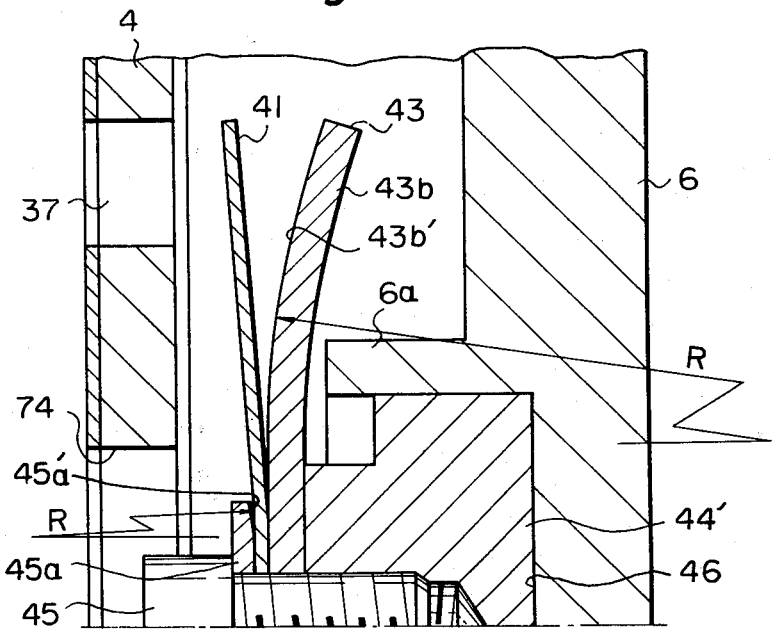

FIGS. 19 through 21 illustrates an improvement of the rear delivery valve 41 of the swash plate type compressor according to the present invention. When the delivery valve 41 is moved from its closing position shown in FIG. 19 to its opening position shown in FIG. 20, the delivery valve 41 is bent away from the valve guard 43 toward the valve plate 4 by the pressure of the refrigerant gas acting on the rear face of the valve 41. As a result, the delivery valve 41 abuts against the outermost edge of the washer **45*a*. Accordingly, the abutting portion of the delivery valve 41 must assume a bending stress which causes a decrease in the operational life of the valve 41. Therefore, if the outer periphery of the washer 45*a* is rounded as illustrated in FIG. 21, generation of the bending stress can be prevented, and a long operation life of the delivery valve 41 can be guaranteed. Further from the same reason, the valve guard 43 should be formed, at its reed portions 43*b*, with a rounded surface 43*b'*, respectively. The starting point of each rounded surface 43*b'* should be arranged away from the outermost edge of the washer 45*a***.

From the foregoing description of the embodiments of the present invention, it will be understood that the compressor according to the present invention can be used as an economical and durable compressor in a vehicle air-conditioning system.

We claim:

1. A multi-cylinder compressor adapted for use in compressing a refrigerant gas of a cooling circuit comprising:

cylinder block means having therein a plurality of compression chambers;

housing means having therein a first and a second delivery chamber into which the refrigerant gas is delivered from said compression chambers, and at least a suction chamber from which the refrigerant gas is sucked into said compression chambers;

valve plate means arranged between said cylinder block means and said housing means, said valve plate means having therein suction ports providing a fluid communication between said compression chambers and said suction chamber, and delivery ports providing a fluid communication between said compression chambers and said first and second delivery chambers;

a suction means for introducing the refrigerant gas from said cooling circuit into said suction chamber;

a delivery means for delivering the refrigerant gas from said first and second delivery chambers to said cooling circuit;

first delivery valve means closing said delivery ports that provide a fluid communication between said compression chambers and said first delivery chamber, said first delivery valve means being opened by said refrigerant gas delivered from said compression chambers into said first delivery chamber;

second delivery valve means capable of moving between a first position for closing said delivery ports that provide a fluid communication between said compression chambers and said second delivery chamber and a second position for opening said delivery ports that provide a fluid communication between said compression chambers and said second delivery chamber;

means for urging said second delivery valve means from said first position toward said second position;

a pressure inlet means for applying to said second delivery valve means either a high delivery pressure to move said second delivery valve means from said second position to said first position against said urging means, or a low suction pressure, permitting said second delivery valve means to be moved from said first position to said second position by said urging means, and;

valve means arranged between said second delivery chamber and said delivery means, said valve means being opened when said second delivery valve means is moved from said second position to said first position.

2. A multi-cylinder compressor according to claim 1, further comprising communicating passage means for providing a fluid communication between said second delivery chamber and a part of a suction circuit in said compressor.

3. A multi-cylinder compressor according to claim 1 or 2, wherein said compressor is a swash plate type compressor, wherein said housing means includes at least a rear housing arranged on the rear end side of said cylinder block means, said rear housing having at its central portion said second delivery chamber and at its outer peripheral portion said suction chamber in the shape of an annular chamber encircling said second delivery chamber, said cylinder block means being formed at its center a shaft bore for a drive shaft, said shaft bore being fluidly connected to a suction circuit of said swash plate type compressor, said second delivery chamber being capable of communicating with said shaft bore when said second delivering valve means is moved to said second position.

4. A multi-cylinder compressor according to claim 1 or 2, wherein said housing means has a first recess communicating with said pressure inlet means, and wherein said second delivery valve means comprises a delivery valve member and a spool member having a front end face to which said valve member is fixed, and a rear end face formed as a pressure receiving surface, said spool member being slidably fitted in said first recess of said housing means, so that said delivery valve member fixed to said spool member is moved from said first position to said second position and vice versa.

5. A multi-cylinder compressor according to claim 4, wherein said housing means has a second recess arranged adjacent to and communicating with said first recess, said second recess further communicating with, on one hand, said pressure inlet means and on the other hand, said second delivery chamber via relief holes, and wherein a check valve is provided in said second recess of said housing means for permitting the flow of said refrigerant gas from said second delivery chamber to said second recess through said relief holes and for preventing the flow of said refrigerant gas from said second recess to said second delivery chamber.

6. A multi-cylinder compressor according to claim 4, wherein said urging means comprises a spring element seated in said cylinder block means and having one end engaging said delivery valve member of said second delivery valve means, said spring element exhibiting a pressure larger than said low suction pressure.

7. A multi-cylinder compressor according to claim 4, wherein said valve plate means is bored with a passage through which said second delivery chamber fluidly communicates with a part of a suction circuit within said compressor when said second delivery valve means is moved away from said valve plate means to said second position, the cross-sectional area of said passage of said valve plate means being chosen so as to be smaller than the surface area of said pressure receiving surface of said spool element, and wherein said spool element is formed with a pressure receiving portion for receiving a pressure for urging said spool element to move away from said valve plate means, said pressure receiving portion having a surface area corresponding to the difference between said surface area of said pressure receiving surface of said spool element and the cross-sectional area of said passage of said valve plate means.

8. A multi-cylinder compressor according to claim 7, wherein where said surface area of said pressure receiving surface of said spool element is $S_1$, the cross-sectional area of said passage of said valve plate means is $S_2$, the cross-sectional area of each of said delivery ports is $S_3$, and the number of said cylinder bores being subjected to suction operation is N, said surface area of said pressure receiving portion has the relationship of $S_1 - S_2 \geqq S_3 \cdot N$.

* * * * *

UNITED STATES PATENT AND TRADEMARK OFFICE

CERTIFICATE OF CORRECTION

PATENT NO. : 4,403,921

DATED : September 13, 1983

INVENTOR(S) : Kimio Kato, et al

It is certified that error appears in the above-identified patent and that said Letters Patent is hereby corrected as shown below:

Col. 1, line 11: change "(i.e." to --i.e., the-- line 12: change "]" to --,-- line 37: change "everytime" to --every time--

Col. 6, line 2 : change "55" to --56--

Signed and Sealed this

*Seventeenth* Day of *January 1984*

[SEAL]

*Attest:*

GERALD J. MOSSINGHOFF

*Attesting Officer*

*Commissioner of Patents and Trademarks*